US009765773B2

(12) United States Patent
Suzuki et al.

(10) Patent No.: US 9,765,773 B2
(45) Date of Patent: Sep. 19, 2017

(54) PUMP HAVING AN INNER AND OUTER ROTOR

(71) Applicant: JTEKT Corporation, Osaka-shi (JP)

(72) Inventors: Masahiko Suzuki, Anjo (JP); Kenichi Takagi, Okazaki (JP)

(73) Assignee: JTEKT CORPORATION, Osaka-shi (JP)

( * ) Notice: Subject to any disclaimer, the term of this patent is extended or adjusted under 35 U.S.C. 154(b) by 67 days.

(21) Appl. No.: 14/222,775

(22) Filed: Mar. 24, 2014

(65) Prior Publication Data

US 2014/0294644 A1 Oct. 2, 2014

(30) Foreign Application Priority Data

Mar. 29, 2013 (JP) ..... 2013-072729

(51) Int. Cl.
*F04C 2/10* (2006.01)

(52) U.S. Cl.
CPC ..... *F04C 2/103* (2013.01); *F04C 2/102* (2013.01); *F04C 2250/102* (2013.01); *F04C 2270/16* (2013.01)

(58) Field of Classification Search
CPC ..... F04C 2/103
USPC ..... 418/61.3, 126
See application file for complete search history.

(56) References Cited

U.S. PATENT DOCUMENTS 7,618,247 B1 * 11/2009 Niemiec ..... F04C 15/062 418/132
2010/0129253 A1 * 5/2010 Nunami et al. ..... 418/61.3
2011/0014078 A1 1/2011 Ono et al.

FOREIGN PATENT DOCUMENTS

| | | | | |
|---|---|---|---|---|
| CN | 101268278 A | 9/2008 | | |
| DE | 4231690 A1 * | 3/1994 | ..... | F04C 14/10 |
| EP | 2 123 914 A1 | 11/2009 | | |
| EP | 2 261 508 A1 | 12/2010 | | |
| JP | 61-8484 A | 1/1986 | | |
| JP | 11-324938 | 11/1999 | | |

OTHER PUBLICATIONS

English Machine Translation of DE4231690A1.*

(Continued)

*Primary Examiner* — Mark Laurenzi
*Assistant Examiner* — Anthony Ayala Delgado
(74) *Attorney, Agent, or Firm* — Oblon, McClelland, Maier & Neustadt, L.L.P.

(57) ABSTRACT

A pump includes: a housing in which a pump chamber that is a columnar space is formed, the pump chamber being provided with a suction-side groove and a discharge-side groove that are formed as recesses; an outer rotor rotatably disposed in the pump chamber and having internal teeth on an inner periphery of the outer rotor; and an inner rotor disposed radially inward of the internal teeth of the outer rotor, and having external teeth formed on an outer periphery of the inner rotor and meshed with the internal teeth of the outer rotor. A portion of an inner edge of the discharge-side groove is located radially inward of a locus of tooth tips of the internal teeth of the outer rotor, the portion being located in a second half region of the discharge-side groove in a rotational direction of the inner rotor and the outer rotor.

6 Claims, 5 Drawing Sheets

(56) References Cited

OTHER PUBLICATIONS

Extended European Search Report issued May 30, 2014 in Patent Application No. 14161917.1.
Japanese Office Action issued Nov. 29, 2016 in Patent Application No. 2013-072729 (with English translation).
English translation of the Office Action issued Feb. 23, 2017 in Chinese Patent Application No. 201410123771.X.

* cited by examiner

SECTION TAKEN ALONG LINE A-A

SECTION TAKEN ALONG LINE B-B

PUMP HAVING AN INNER AND OUTER ROTOR

INCORPORATION BY REFERENCE

The disclosure of Japanese Patent Application No. 2013-072729 filed on Mar. 29, 2013 including the specification, drawings and abstract is incorporated herein by reference in its entirety.

BACKGROUND OF THE INVENTION

1. Field of the Invention

The invention relates to a pump that sucks in and discharges fluid such as oil.

2. Description of the Related Art

As described in Japanese Patent Application Publication No. 11-324938 (JP 11-324938 A), an oil pump used in an automobile includes an outer rotor, an inner rotor and a housing having a pump chamber in which the outer rotor and the inner rotor are rotatably accommodated. Internal teeth formed in a trochoidal curve shape are formed on the inner periphery of the outer rotor. External teeth formed in a trochoidal curve shape are formed on the outer periphery of the inner rotor, and meshed with the internal teeth of the outer rotor. The inner rotor is rotated by a motor.

The housing has a suction passage and a discharge passage that are communicated with the pump chamber. The pump chamber of the housing has a bottom portion in which a suction-side groove communicated with the suction passage and a discharge-side groove communicated with the discharge passage are formed as recesses. The suction-side groove and the discharge-side groove are apart from each other and extend along the circumferential direction of the bottom portion of the pump chamber. In the oil pump configured as described above, the inner rotor and the outer rotor rotate while being meshed with each other. Thus, the oil sucked in through the suction passage is discharged through the discharge passage.

In some conventional pumps, an inner edge of a discharge-side groove is located radially outward of the bottom lands of external teeth of an inner rotor. This is because, if the length of contact between the inner rotor and a bottom portion of a pump chamber in the radial direction is set longer, it is possible to suppress leakage of the oil from spaces defined between the external teeth and the internal teeth into a side clearance that is a clearance between the bottom portion of the pump chamber and the inner rotor, thereby enhancing the efficiency of the pump.

If the inner edge of the discharge-side groove is located radially outward of the bottom lands of the external teeth of the inner rotor, the tooth tips of the internal teeth may be overlapped with the inner edge of the discharge-side groove. In this case, the spaces defined between the external teeth and the internal teeth are turned into closed spaces that are not opened into the discharge-side groove. When the volumes of the closed spaces are decreased as the inner rotor and the outer rotor rotate, the oil in the closed spaces flows at a high flow rate into spaces between the internal teeth and the external teeth, which are opened into the discharge-side groove. This raises a possibility that the inner edge of the discharge-side groove will be damaged.

SUMMARY OF THE INVENTION

One object of the invention is to provide a pump configured such that damage to an inner edge of a discharge-side groove is reduced.

An aspect of the invention relates to a pump including: a housing in which a pump chamber that is a columnar space is formed, the pump chamber being provided with a suction-side groove and a discharge-side groove that are formed as recesses; an outer rotor rotatably disposed in the pump chamber and having internal teeth on an inner periphery of the outer rotor; and an inner rotor disposed radially inward of the internal teeth of the outer rotor, and having external teeth formed on an outer periphery of the inner rotor and meshed with the internal teeth of the outer rotor. A portion of an inner edge of the discharge-side groove is located radially inward of a locus of tooth tips of the internal teeth of the outer rotor, the portion being located in a second half region of the discharge-side groove in a rotational direction of the inner rotor and the outer rotor.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
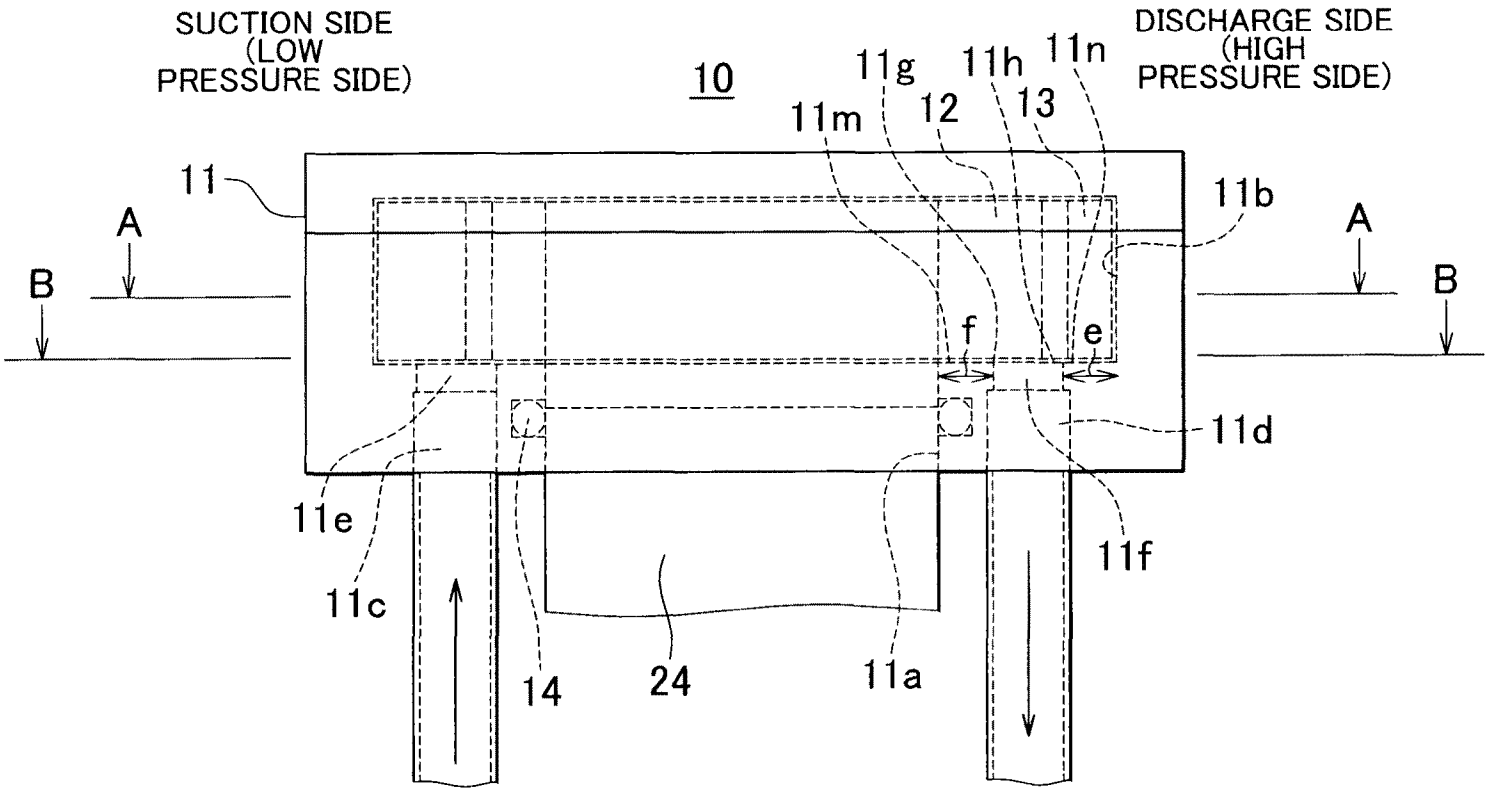
FIG. 1 is a side view of a pump.
Figure 2:
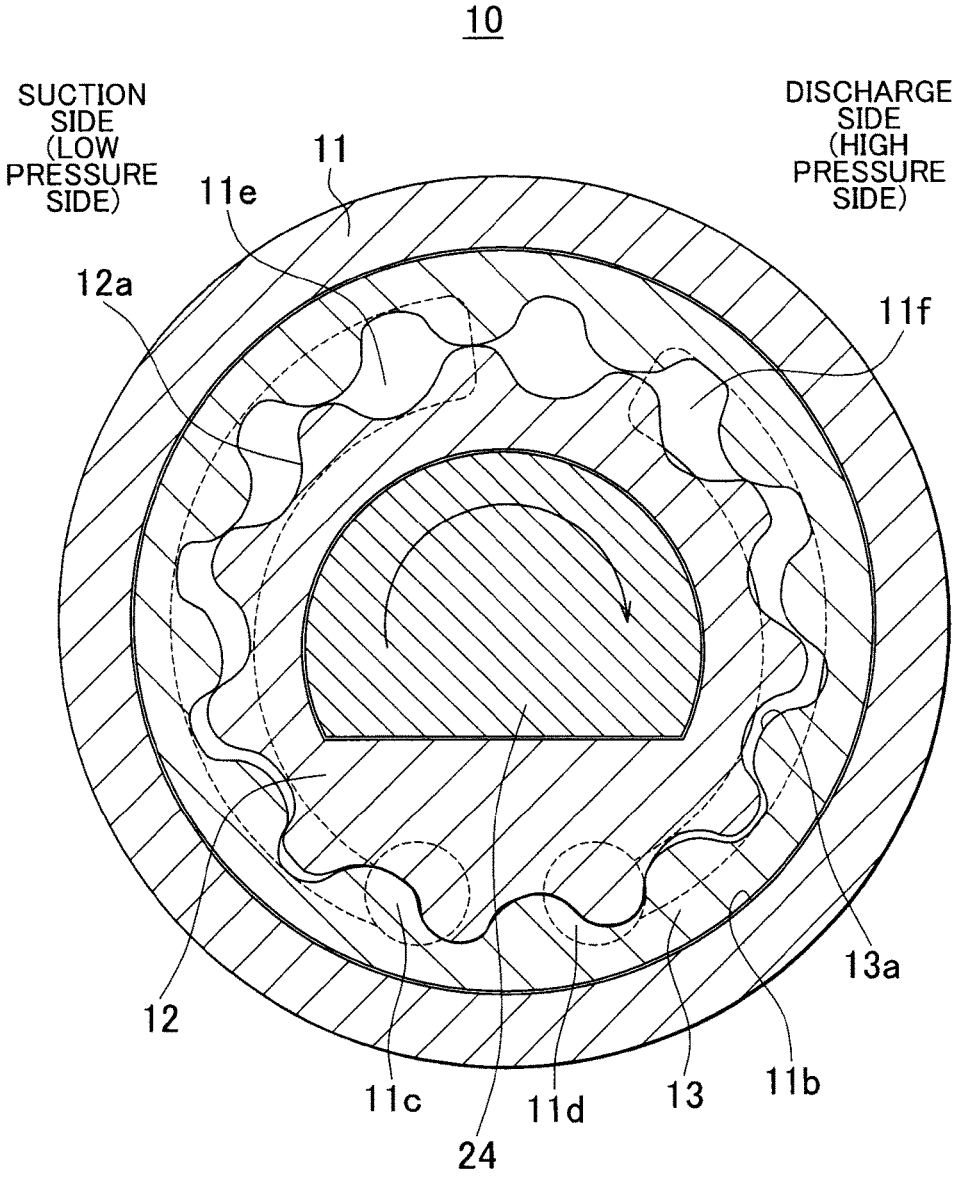
FIG. 2 is a sectional view of the pump taken along the line A-A in FIG. 1, illustrating an inner rotor and an outer rotor.

Hereinafter, an embodiment of the invention will be described with reference to the accompanying drawings. As illustrated in FIG. 1 and FIG. 2, a pump 10 includes a housing 11, an inner rotor 12, an outer rotor 13 and a seal member 14. In the following description, the rotational direction (indicated by an arrow in FIG. 2) of the inner rotor 12 and the outer rotor 13 will be simply referred to as "rotational direction".

The housing 11 has a block shape, and a pump chamber 11*b* that is a flat columnar space is formed in the housing 11. As illustrated in FIG. 1, an insertion hole 11*a* communicated with the pump chamber 11*b* is formed at the center of a bottom portion of the housing 11. A rotary shaft 24 is passed through the insertion hole 11*a*. The seal member 14 having a ring shape is fitted in the insertion hole 11*a*. The seal member 14 contacts the rotary shaft 24 over the entire circumference thereof to seal a gap between the housing 11 and the rotary shaft 24. Note that the rotary shaft 24 is rotated by an engine, a transmission, a motor, or the like (none of which is illustrated).

As illustrated in FIG. 2, the outer rotor 13 is rotatably disposed in the pump chamber 11*b*. The outer rotor 13 has a circular sectional shape and a short cylinder shape. Internal teeth 13*a* are formed on the inner periphery of the outer rotor 13 so as to define spaces. The inner rotor 12 is rotatably disposed at a position radially inward of the internal teeth 13*a*.

Figure 4:
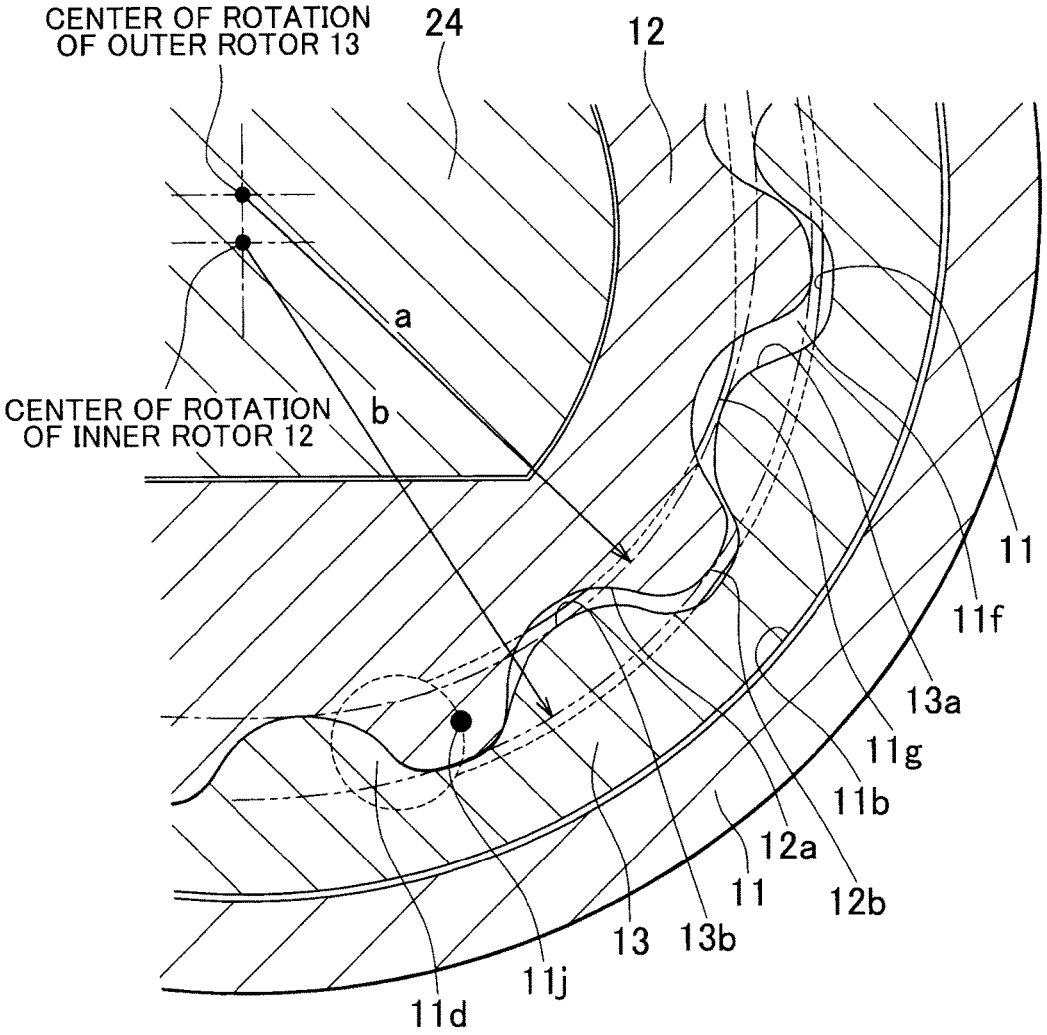
FIG. 4 is an enlarged view of the pump in FIG. 3.

The inner rotor 12 has a ring shape, and external teeth 12*a* are formed at an outer peripheral edge of the inner rotor 12. The internal teeth 13*a* and the external teeth 12*a* are defined by a plurality of trochoidal curves. The number of the external teeth 12*a* is smaller than that of the internal teeth 13*a*. The internal teeth 13*a* and the external teeth 12*a* are meshed with each other. The center of rotation of the outer rotor 13 is coincident with the center of the columnar pump chamber 11*b*. As illustrated in FIG. 4, the center of rotation of the inner rotor 12 is offset from the center of rotation of the outer rotor 13. The inner rotor 12 is concentrically fitted on the rotary shaft 24, and the inner rotor 12 and the rotary shaft 24 rotate together with each other.

Figure 3:
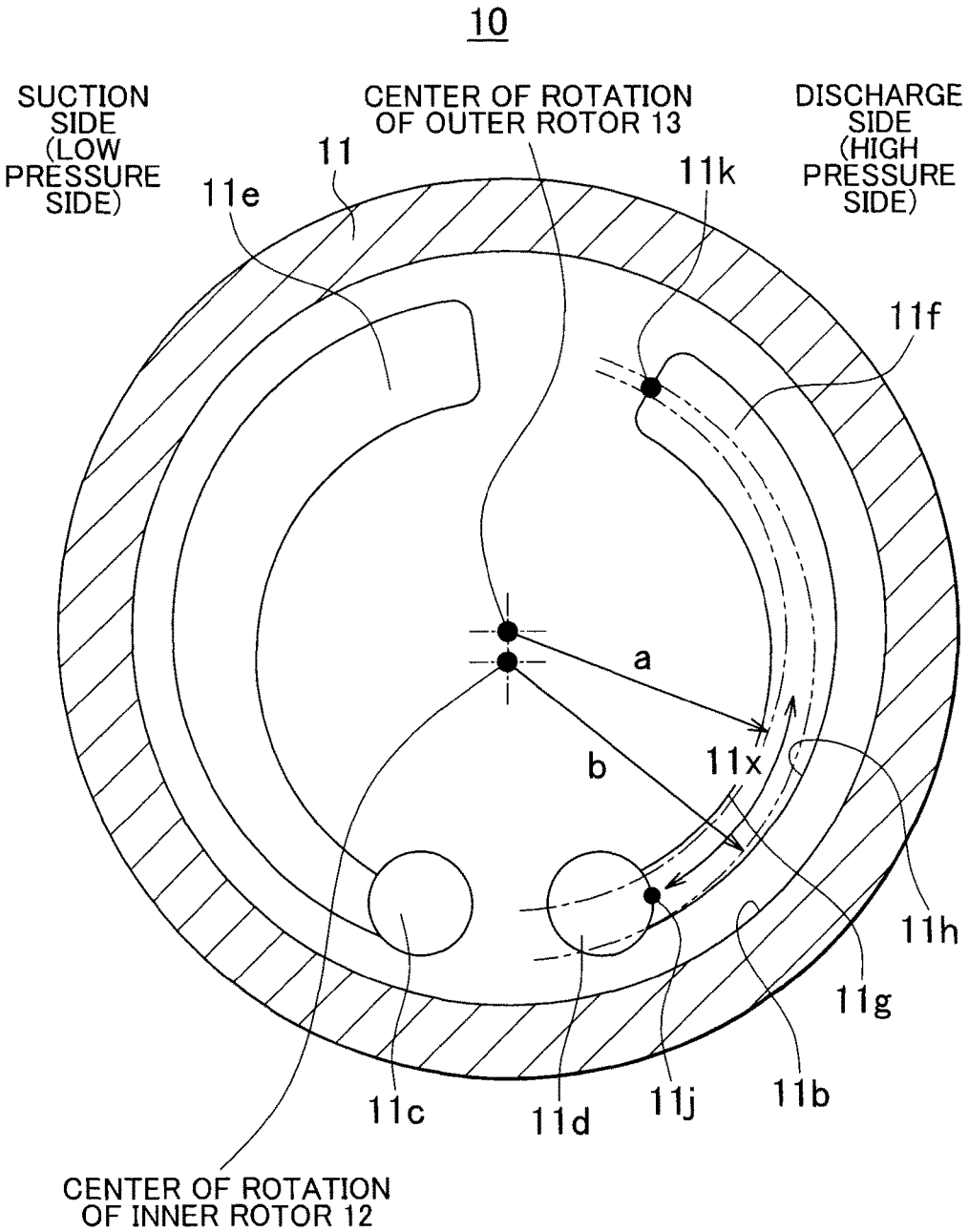
FIG. 3 is a sectional view of the pump taken along the line B-B in FIG. 1, illustrating a bottom portion of a housing.

As illustrated in FIG. 2 and FIG. 3, a suction-side groove 11*e* and a discharge-side groove 11*f* that have a crescent shape are formed as recesses in at least one of opposed faces that define the columnar space of the pump chamber 11*b*. In the present embodiment, the suction-side groove 11*e* and the discharge-side groove 11*f* are formed as recesses in a bottom portion of the pump chamber 11*b*. The suction-side groove 11*e* and the discharge-side groove 11*f* are located at predetermined intervals and extend along the circumferential direction of the bottom portion of the pump chamber 11*b*. The suction-side groove 11*e* and the discharge-side groove 11*f* are opposed to each other in the bottom portion of the pump chamber 11*b*. The suction-side groove 11*e* and the discharge-side groove 11*f* are formed on a locus on which the spaces defined between the external teeth 12*a* and the internal teeth 13*a* move. As illustrated in FIG. 1 and FIG. 3, the side of the pump chamber 11*b*, in which the suction-side groove 11*e* is formed, will be referred to as "suction side", and the side of the pump chamber 11*b*, in which the discharge-side groove 11*f* is formed, will be referred to as "discharge side".

As illustrated in FIG. 3 and FIG. 4, an inner edge 11*g* of the discharge-side groove 11*f* is located radially inward of a locus (with a radius a) of tooth tips 13*b* of the internal teeth 13*a* of the outer rotor 13, at least over a second half region 11*x* of the discharge-side groove 11*f* in the rotational direction of the inner rotor 12 and the outer rotor 13. An outer edge 11*h* of the discharge-side groove 11*f* is located radially outward of a locus (with a radius b) of the tooth tips 12*b* of the external teeth 12*a* of the inner rotor 12, at least over the second half region 11*x* of the discharge-side groove 11*f*.

The second half region 11*x* of the discharge-side groove 11*f* is a region extending from a trailing end 11*j* of the discharge-side groove 11*f* to a position apart from the trailing end 11*j* in a direction toward a leading end 11*k* of the discharge-side groove 11*f* by a predetermined distance, as illustrated in FIG. 3. In the second half region 11*x*, closed spaces 91, 92 (described later) may be formed. The trailing end 11*j* of the discharge-side groove 11*f* is located at a position at which the spaces defined between the external teeth 12*a* and the internal teeth 13*a* finish passing by the discharge-side groove 11*f* and exit from the discharge-side groove 11*f*. The leading end 11*k* of the discharge-side groove 11*f* is located at a position at which the spaces defined between the external teeth 12*a* and the internal teeth 13*a* enter the first the discharge-side groove 11*f*.

In the present embodiment, the inner edge 11*g* of the discharge-side groove 11*f* is located radially inward of the locus (with the radius a) of the tooth tips 13*b* of the internal teeth 13*a* of the outer rotor 13, over a region from the leading end 11*k* to the trailing end 11*j* of the discharge-side groove 11*f*. The outer edge 11*h* of the discharge-side groove 11*f* is located radially outward of the locus (with the radius b) of the tooth tips 12*b* of the external teeth 12*a* of the inner rotor 12, over the region from the leading end 11*k* to the trailing end 11*j* of the discharge-side groove 11*f*.

As illustrated in FIG. 1 and FIG. 3, a suction passage 11*c* is formed in the housing 11 and is communicated with a bottom portion of the suction-side groove 11*e* and thus communicated with the pump chamber 11*b*. The position at which the suction passage 11*c* is communicated with the bottom portion of the suction-side groove 11*e* is coincident with a leading end of the suction-side groove 11*e*, at which the spaces defined between the external teeth 12*a* and the external teeth 13*a* enter the suction passage 11*c*. A discharge passage 11*d* is formed in the housing 11 and is communicated with a bottom portion of the discharge-side groove 11*f* and thus communicated with the pump chamber 11*b*. The position at which the discharge passage 11*d* is communicated with the bottom portion of the discharge-side groove 11*f* is coincident with the trailing end 11*j* of the discharge-side groove 11*f*.

As the rotary shaft 24 rotates, the inner rotor 12 rotates and thus the outer rotor 13 engaged at the internal teeth 13*a* with the external teeth 12*a* of the inner rotor 12 also rotates. Thus, the spaces defined between the external teeth 12*a* and the internal teeth 13*a* pass by the suction passage 11*c*, the suction-side groove 11*e*, the discharge-side groove 11*f* and the discharge passage 11*d* in this order, and thus the oil is delivered from the suction passage 11*c* into the discharge passage 11*d*. The pressure of the oil is higher on the discharge side (high pressure side) of the pump chamber 11*b* than on the suction side (low pressure side) of the pump chamber 11*b* during the operation of the pump 10.

Next, a conventional pump as a comparative example will be described, with a focus on differences from the pump 10 in the present embodiment. Before the conventional pump is described, an inner side clearance 11*m* and an outer side clearance 11*n* will be described. As illustrated in FIG. 1, the inner side clearance 11*m* is a clearance defined between a bottom face of the pump chamber 11*b* of the housing 11 and a side face of the inner rotor 12. The outer side clearance 11*n* is a clearance defined between the bottom face of the pump chamber 11*b* of the housing 11 and a side face of the outer rotor 13.

If the oil leaks from the spaces defined between the external teeth 12*a* and the internal teeth 13*a* into the inner side clearance 11*m* or the outer side clearance 11*n*, the quantity of the oil discharged into the discharge-side groove 11*f* is decreased, and thus the efficiency of the pump 10 is reduced.

Figure 5:
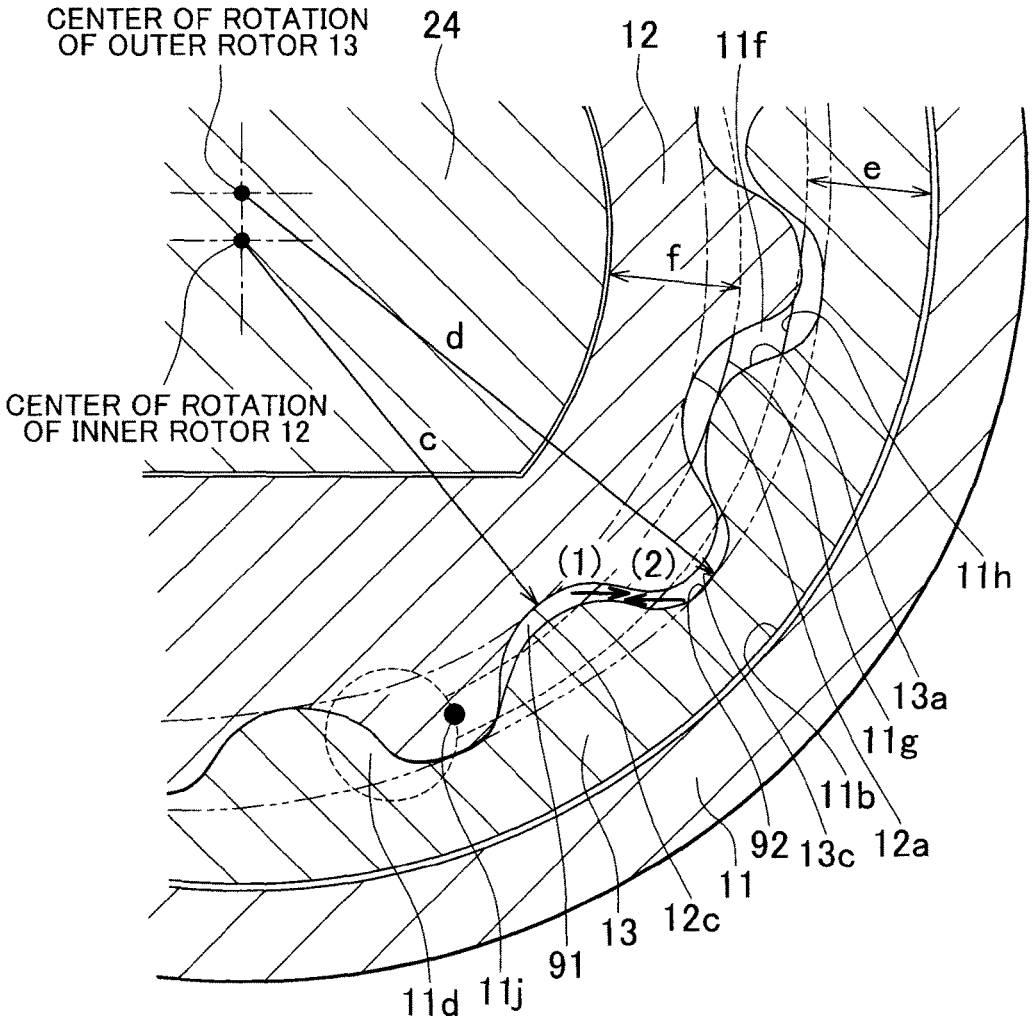
FIG. 5 is a view of a pump in a comparative example.

Therefore, in the conventional pump, as illustrated in FIG. 5, the inner edge 11*g* of the discharge-side groove 11*f* is located radially outward of the locus (with a radius c) of bottom lands 12*c* of the external teeth 12*a* of the inner rotor 12. Thus, as illustrated in FIG. 1 and FIG. 5, a length f of contact between the inner rotor 12 and the bottom portion of the pump chamber 11*b* in the radial direction becomes longer and thus leakage of the oil from the spaces defined between the external teeth 12*a* and the internal teeth 13*a* into the inner side clearance 11*m* is suppressed.

In addition, in the conventional pump, the outer edge 11*h* of the discharge-side groove 11*f* is located radially inward of the locus (with a radius d) of bottom lands 13*c* of the internal teeth 13*a* of the outer rotor 13. Thus, as illustrated in FIG. 1 and FIG. 5, a length e of contact between the outer rotor 13 and the bottom portion of the pump chamber 11*b* in the radial direction becomes longer and thus leakage of the oil from the spaces defined between the external teeth 12*a* and the internal teeth 13*a* into the outer side clearance 11*n* is suppressed.

The spaces defined between the external teeth 12*a* of the inner rotor 12 and the internal teeth 13*a* of the outer rotor 13 become narrower as they are advanced from the leading end 11*k* to the trailing end 11*j* of the discharge-side groove 11*f*. In the conventional pump, the inner edge 11*g* of the discharge-side groove 11*f* is located radially outward of the locus (with the radius c) of the bottom lands 12*c* of the external teeth 12*a* of the inner rotor 12 and the outer edge 11*h* of the discharge-side groove 11*f* is located radially inward of the locus (with the radius d) of the bottom lands 13*c* of the internal teeth 13*a* of the outer rotor 13.

Thus, in the conventional pump, as illustrated in FIG. 5, the tooth tips 13*b* of the internal teeth 13*a* may overlap with the inner edge 11*g* of the discharge-side groove 11*f*, in the second half region of the discharge-side groove 11*f*. In this case, one of the spaces between the external teeth 12*a* and the internal teeth 13*a* is turned into the closed space 91 that is not opened to the discharge-side groove 11*f*. Further, the tooth tips 12*b* of the external teeth 12*a* may overlap with the outer edge 11*h* of the discharge-side groove 11*f*, in the second half region 11*x* of the discharge-side groove 11*f*. In this case, one of the spaces between the external teeth 12*a* and the internal teeth 13*a* is turned into the closed space 92 that is not opened to the discharge-side groove 11*f*.

The volumes of the closed spaces 91, 92 formed as described above are decreased as the inner rotor 12 and the outer rotor 13 rotate. As a result, the oil in the closed spaces 91, 92 flows at a high flow rate into the spaces that are defined between the external teeth 12*a* and the internal teeth 13*a* and that are opened into the discharge-side groove 11*f* (refer to (1) and (2) in FIG. 5). This raises a possibility that the inner edge 11*g* or the outer edge 11*h* of the discharge-side groove 11*f* will be damaged, in part of the bottom portion of the pump chamber 11*b* in which the closed spaces 91, 92 are formed, that is, in the second half region 11*x* of the discharge-side groove 11*f*. Further, there is a possibility that the external teeth 12*a* and the internal teeth 13*a* will be damaged.

Especially in the closed space 91, a centrifugal force is exerted on the oil as the inner rotor 12 and the outer rotor 13 rotate, and thus the flow of the oil from the closed space 91 into the discharge-side groove 11*f* is accelerated. Thus, there is a possibility that the inner edge 11*g* of the discharge-side groove 11*f* will be damaged more, in the second half region of the discharge-side groove 11*f*.

As described above in detail, because the inner edge 11*g* of the discharge-side groove 11*f* is located radially inward of the locus (with the radius a) of the tooth tips 13*b* of the internal teeth 13*a* of the outer rotor 13, no closed space 91 (illustrated in FIG. 5) is formed as illustrated in FIG. 3 and FIG. 4. Thus, even if the volumes of the spaces defined between the external teeth 12*a* and the internal teeth 13*a* are deceased as the inner rotor 12 and the outer rotor 13 rotate, the oil in the spaces is discharged into the discharge-side groove 11*f*, at the inner edge 11*g* of the discharge-side groove 11*f*. As a result, it is possible to reduce damage to the inner edge 11*g* of the discharge-side groove 11*f* formed in the bottom portion of the pump chamber 11*b*. Further, it is possible to reduce damage to the external teeth 12*a* and the internal teeth 13*a*.

Note that the formation of the closed space 91 is prevented even if the inner edge 11*g* of the discharge-side groove 11*f* is located radially inward of the locus of the bottom lands 12*c* of the external teeth 12*a* of the inner rotor 12. However, in this case, because the length f of contact between the inner rotor 12 and the bottom portion of the pump chamber 11*b* in the radial direction is decreased, the amount of oil that leaks into the inner side clearance 11*m* is increased. In the present embodiment, the inner edge 11*g* of the discharge-side groove 11*f* is located radially inward of the locus of the tooth tips 13*b* of the internal teeth 13*a* of the outer rotor 13. Thus, the length f of contact between the inner rotor 12 and the bottom portion of the pump chamber 11*b* in the radial direction is sufficiently ensured while formation of the closed space 91 is prevented. As a result, it is possible to suppress leakage of the oil into the inner side clearance 11*m*.

Further, because the outer edge 11*h* of the discharge-side groove 11*f* is located outward of the locus of the tooth tips 12*b* of the external teeth 12*a* of the inner rotor 12, no closed space 92 (refer to FIG. 5) is formed. Thus, even if the volumes of the spaces defined between the external teeth 12*a* of the inner rotor 12 and the internal teeth 13*a* of the outer rotor 13 are decreased as the inner rotor 12 and the outer rotor 13 rotate, the oil is discharged from the spaces into the discharge-side groove 11*f* through a gap at the outer edge 11*h* of the discharge-side groove 11*f*. Thus, it is possible to reduce damage to part of the bottom portion of the pump chamber 11*b*, which is adjacent to the outer edge 11*h* of the discharge-side groove 11*f*. Further, it is possible to reduce damage to the external teeth 12*a* and the internal teeth 13*a*.

Note that the formation of the closed space 92 is prevented even if the outer edge 11*h* of the discharge-side groove 11*f* is located radially outward of the locus of the bottom lands 13*c* of the internal teeth 13*a* of the outer rotor 13. However, in this case, because the length e of contact between the outer rotor 13 and the bottom portion of the pump chamber 11*b* in the radial direction is decreased, the amount of oil that leaks into the inner side clearance 11*n* is increased. In the present embodiment, the outer edge 11*h* of the discharge-side groove 11*f* is located radially outward of the locus of the tooth tips 12*b* of the external teeth 12*a* of the inner rotor 12. Thus, the length e of contact between the outer rotor 13 and the bottom portion of the pump chamber 11*b* in the radial direction is sufficiently ensured while formation of the closed space 92 is prevented. As a result, it is possible to suppress leakage of the oil into the inner side clearance 11*n*.

The invention may be implemented in an embodiment in which the inner edge 11*g* of the discharge-side groove 11*f* is located radially outward of the locus (with the radius c) of the bottom lands 12*c* of the external teeth 12*a* of the inner rotor 12 and is also located radially inward of the locus (with the radius a) of the tooth tips 13*b* of the internal teeth 13*a* of the outer rotor 13. The invention may be implemented in an embodiment in which the outer edge 11*h* of the discharge-side groove 11*f* is located radially inward of the locus (with the radius d) of the bottom lands 13*c* of the internal teeth 13*a* of the outer rotor 13 and is also located radially outward of the locus of the tooth tips 12*b* of the external teeth 12*a* of the inner rotor 12.

In these embodiments, the lengths f, e of contact between the inner and outer rotors 12, 13 and the bottom of the pump chamber 11*b* in the radial direction are set longer, and thus the formation of the closed spaces 91, 92 (refer to FIG. 5) is prevented while the leakage of the oil into the side clearances 11*m*, 11*n* is suppressed. Thus, it is possible to reduce damage to the bottom portion of the pump chamber 11*b*, the external teeth 12*a* and the internal teeth 13*a*.

In the embodiments described above, the entirety of the inner edge 11*g* of the discharge-side groove 11*f* is located radially inward of the locus of the tooth tips 13*b* of the internal teeth 13*a* of the outer rotor 13. Alternatively, the invention may be implemented in an embodiment in which only a portion of the inner edge 11*g*, the portion being in the second half region 11*x* of the discharge-side groove 11*f*, is partially located radially inward of the locus of the tooth tips 13*b* of the internal teeth 13*a* of the outer rotor 13, or in an embodiment in which only the portion of the inner edge 11*g*, the portion being in the second half region 11*x* of the discharge-side groove 11*f*, is entirely located radially inward of the locus of the tooth tips 13*b* of the internal teeth 13*a* of the outer rotor 13. In these embodiments, it is possible to reduce damage to a portion of the inner edge 11*g* of the discharge-side groove 11*f*, the portion being located radially inward of the locus of the tooth tips 13*b* of the internal teeth 13*a* of the outer rotor 13.

In the embodiments described above, the entirety of the outer edge 11*h* of the discharge-side groove 11*f* is located radially outward of the locus of the tooth tips 12*b* of the external teeth 12*a* of the inner rotor 12. Alternatively, the invention may be implemented in an embodiment in which only a portion of the outer edge 11*h*, the portion being in the second half region 11*x* of the discharge-side groove 11*f*, is partially located radially outward of the locus of the tooth tips 12*b* of the external teeth 12*a* of the inner rotor 12, or in an embodiment in which only the portion of the outer edge 11*h*, the portion being in the second half region 11*x* of the discharge-side groove 11*f*, is entirely located radially outward of the locus of the tooth tips 12*b* of the external teeth 12*a* of the inner rotor 12. In these embodiments, it is possible to reduce damage to a portion of the outer edge 11*h* of the discharge-side groove 11*f*, the portion being located radially outward of the locus of the tooth tips 12*b* of the external teeth 12*a* of the inner rotor 12.

In the embodiments described above, only one discharge-side groove 11*f* is formed in the bottom portion of the pump chamber 11*b*. However, the invention may be implemented in an embodiment in which two or more discharge-side grooves 11*f* are formed in the bottom portion of the pump chamber 11.

What is claimed is:

1. A pump comprising:

a housing in which a pump chamber that is a circular columnar space is formed, the pump chamber being provided with a suction-side groove and a discharge-side groove that are formed as recesses;

an outer rotor rotatably disposed in the pump chamber to rotate about a center of rotation at the center of the circular columnar space, wherein the outer rotor has internal teeth on an inner periphery of the outer rotor; and an inner rotor disposed radially inward of the internal teeth of the outer rotor, and having external teeth formed on an outer periphery of the inner rotor and meshed with the internal teeth of the outer rotor;

wherein an inner edge of the discharge-side groove is located radially inward of a locus of tooth tips of the internal teeth of the outer rotor over an entirety of a second half of the discharge-side groove in a rotational direction of the inner rotor and the outer rotor, and wherein the inner edge of the discharge-side groove is located radially outward of a locus of the bottom lands of the external teeth of the inner rotor in at least the second half of the discharge-side groove in the rotational direction.

2. The pump according to claim 1, wherein the portion of the inner edge in the second half region of the discharge-side groove is entirely located radially inward of the locus of the tooth tips of the internal teeth of the outer rotor.

3. The pump according to claim 1, wherein the inner edge of the discharge-side groove is entirely located radially inward of the locus of the tooth tips of the internal teeth of the outer rotor.

4. The pump according to claim 1, wherein a portion of an outer edge of the discharge-side groove is located radially outward of a locus of tooth tips of the external teeth of the inner rotor, the portion being located in the second half region of the discharge-side groove.

5. The pump according to claim 2, wherein a portion of an outer edge of the discharge-side groove is located radially outward of a locus of tooth tips of the external teeth of the inner rotor, the portion being located in the second half region of the discharge-side groove.

6. The pump according to claim 3, wherein a portion of an outer edge of the discharge-side groove is located radially outward of a locus of tooth tips of the external teeth of the inner rotor, the portion being located in the second half region of the discharge-side groove.

* * * * *